United States Patent [19]

Clements et al.

[11] Patent Number: 5,060,439

[45] Date of Patent: Oct. 29, 1991

[54] EXPANSION JOINT COVER ASSEMBLIES

[75] Inventors: Matthew J. Clements; Maxim A. Fedor, both of Pittsburgh, Pa.; Jerry T. Moffitt, Wexford, Pa.; Lisa Ye, Syracuse, N.Y.; John F. Wadsworth, San Francisco, Calif.

[73] Assignee: Watson Bowman Acme Corp., Amherst, N.Y.

[21] Appl. No.: 540,071

[22] Filed: Jun. 19, 1990

[51] Int. Cl.[5] ..... E04B 1/68; E04C 11/02

[52] U.S. Cl. ..... 52/396; 52/468; 52/278; 52/573; 404/47; 404/54

[58] Field of Search ..... 52/396, 573, 278, 468, 52/400, 401; 404/53, 54, 60, 47

[56] References Cited

U.S. PATENT DOCUMENTS

| | | | |
|---|---|---|---|
| 3,170,268 | 2/1965 | Balzer et al. | 50/173 |
| 3,659,390 | 5/1972 | Balzer et al. | 52/464 |
| 3,750,359 | 8/1973 | Balzer et al. | 52/468 |
| 3,797,188 | 3/1974 | Mansfeld | 52/396 |
| 3,849,995 | 11/1974 | Balzer et al. | 52/396 |
| 4,184,298 | 1/1980 | Balzer et al. | 52/396 |
| 4,504,170 | 3/1985 | Schukolinski | 404/55 |
| 4,885,885 | 12/1989 | Gottschling | 52/396 |
| 4,901,495 | 2/1990 | Gottschling | 52/396 |

*Primary Examiner*—David A. Scherbel
*Assistant Examiner*—Kien T. Nguyen
*Attorney, Agent, or Firm*—Jones, Day, Reavis & Pogue

[57] ABSTRACT

Expansion joint cover assemblies are disclosed which are structured and dimensioned for use in covering expansion joints or spaces between adjacent structural sections of a building such as spaced floors or floor and wall sections. The assemblies include base members adapted to be positioned and secured to the adjacent structural sections and a leaf spring cover member fixedly interconnected to one of the base members at one end and bridging the expansion joint or space between the structural sections in a cantilever manner such that the cover member lies in a plane essentially flush with the floor section or sections and is structured and dimensioned to be slidably interconnected with the other base member to provide a secure, functionally effective and aesthetically pleasing assembly for accommodating translational relative movement of the structural sections.

20 Claims, 5 Drawing Sheets

EXPANSION JOINT COVER ASSEMBLIES

BACKGROUND OF THE INVENTION

The present invention relates to expansion joint cover assemblies of the type employed to bridge spaces between relatively movable structural elements such as floors or walls. More particularly, the assemblies of the present invention are suitable for use in covering expansion joints between adjacent, spaced, relatively movable structural sections such as floors or floors and walls in a manner such as to enable effective expansion performance of the joint while presenting an aesthetically improved appearance.

A variety of expansion joint covers have been disclosed heretofore. However, such prior assemblies have presented numerous unresolved problems in regard to their mechanical operation and/or aesthetic appeal. For example, some of the prior devices have not functioned to adequately accommodate relative movement of the structural sections adjacent the expansion joint. Other prior devices have exhibited mounting and installation problems as well as problems in regard to the maintenance of their position within the expansion joint throughout prolonged periods of use. Prior expansion joint covers have also encountered problems in regard to continued operability in the event of build up of dirt deposits within the operating components of the assemblies.

From an aesthetic standpoint, prior expansion cover assemblies have not been satisfactorily designed and structured. Prior devices have been constructed in a manner such that the metal and/or plastic surface of the cover is exposed after assembly and installation resulting in a generally undesirable and unattractive appearance which does not blend in with the surroundings and adjacent construction.

One example of the many varieties of prior art expansion joint covers which have been proposed to overlie elongate expansion joints between adjacent building sections such as floors or floors and walls is disclosed in U.S. Pat. No. 3,705,359, issued Aug. 7, 1973, to C.P. Balzer et. al. In that patent, a free-floating elongate arcuate rigid cover or plate member is disclosed for use in bridging the span between adjacent, spaced floor sections. For purposes of providing a covering between floor and wall sections, an assembly is disclosed wherein the free-floating cover or plate is replaced with a rigid cover or plate member which is pivotally connected via a hinge arrangement to the wall.

These prior devices have presented problems in regard to mechanical functionality as well as to aesthetic appearance. For example, it has been found that free-floating covers which are not fastened or secured in assembly present problems in remaining centered over the expansion opening as required to enable continued effective utilization. Hinged or pivotal connections for wall to floor installations also have been found to present operational difficulties, for example, in view of dirt accumulation in the hinge area which prevents proper pivotal operation of the assembly. Furthermore, with regard to devices such as those disclosed in U.S. Pat. 3,705,359, a significant problem is presented regarding the high degree of exposed metal or plastic surface which is observable after the assembly is installed in a location whereas a major concern of developers of such cover assembly products is to minimize exposure of the surface in order to enhance the aesthetic properties of the installed assembly.

Further examples of prior expansion joint cover assemblies are disclosed in U.S. Pat. Nos. 3,170,268; 3,659,390; 3,797,188; 3,849,958; 4,184,298; 4,504,170; 4,885,885 and 4,901,495. In each of these patents, a distinct cover arrangement is disclosed for bridging the gap between adjacent structural sections to accommodate relative movement therebetween.

Thus, it has been a continuing problem for the developers of expansion joint cover assemblies to provide functionally effective products which are cost effective and are constructed in a manner enabling ease of installation and which provide adequate initial and long term mechanical operability. Furthermore, it has been a continuing problem to provide cover assemblies which provide floor joints which are flush with the finished floor construction.

In addition, the developers of expansion joint cover assemblies have encountered significant problems in creating aesthetically pleasing structures which only display a minimum of exposed metal or other material surface upon installation allowing the cover to blend in with the surroundings and adjacent construction.

SUMMARY OF THE INVENTION

Therefore, the present invention provides expansion joint cover assemblies specifically structured and dimensioned for use in covering expansion joints or spaces between adjacent structural sections of a building such as spaced floors or floor and wall sections. The assemblies include base members adapted to be positioned and secured to the adjacent structural sections and a leaf spring cover member fixedly interconnected to one of the base members at one end and bridging the expansion joint or space between the structural sections in a cantilever manner such that the cover member lies in a plane essentially flush or coextensive with the floor section or sections and is structured and dimensioned to be slidably interconnected with the other base member to provide a secure and functionally effective assembly for accommodating translational relative movement of the structural sections.

More particularly, it is a significant feature of the present invention that the assembly is constructed in a manner such that, when installed, only minimal surface area of the component parts of the assembly is exposed to view. This construction enables the assembly to blend in with the surroundings and adjacent construction providing an aesthetically attractive appearance.

A further feature of the present invention is to provide an expansion joint cover assembly that is constructed such that the cover is essentially coplanar or flush with adjacent structural floor sections.

It is another feature of this invention that the assembly is adapted to accommodate multi-directional relative movement o adjacent structural surfaces and to function effectively over long periods of time without encountering mechanical difficulties.

It is still another important feature of the present invention that the assemblies are constructed for efficient and easy mounting and installation. Furthermore, the assemblies are cost efficient in production.

These features and advantages are obtained, and it is a general object of the present invention to obtain these advantages by providing an aesthetically attractive, cost efficient expansion joint cover assembly which possesses necessary performance characteristics in movement and sealing and which may be mounted and installed with facility. The assembly is inset into the joint between structural floor and/or wall sections and is structured and dimensioned to provide a outer surface cover for the joint which is essentially coplanar or flush with the adjacent structural sections with only minimal exposure of the surface of the assembly.

The expansion joint cover assembly comprises a first elongate base member stationarily secured to a first structural section and a second elongate base member positioned within a recess formed in a second structural section adjacent the first structural section and spaced therefrom. The second base member is stationarily secured to the second structural section. The cover assembly further includes an elongate cover member having oppositely disposed, longitudinally spaced first and second end sections with the first end section fixedly interconnected with the first base member and the second base member includes a passageway therein for receiving the second end section of the cover member in supporting, sliding engagement. The cover member extends across a joint or space formed between the adjacent structural sections in a cantilever manner overlying and covering the joint with said second end section of the cover member inserted in said passageway to accommodate relative movement of the adjacent, spaced structural sections and to assure proper alignment of the cover member.

DESCRIPTION OF THE PREFERRED EMBODIMENT

Figure 1:
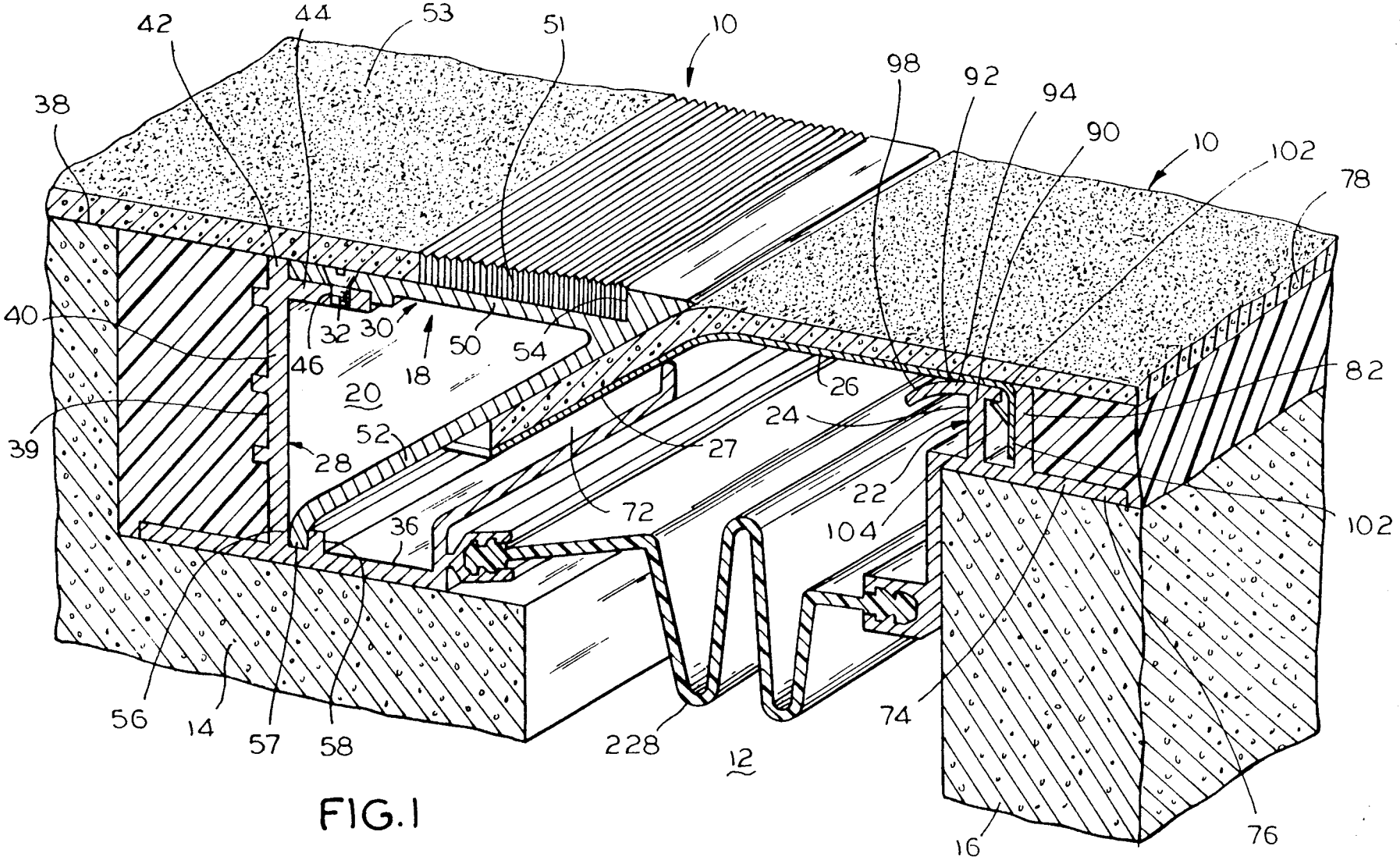
FIG. 1 is a partial perspective view of an expansion joint cover assembly in accordance with the present invention installed to cover an expansion joint between adjacent carpeted floor sections.

A description of the invention follows referring to the drawings in which like reference numerals denote like elements of structure in each of the several figures.

Figure 2:
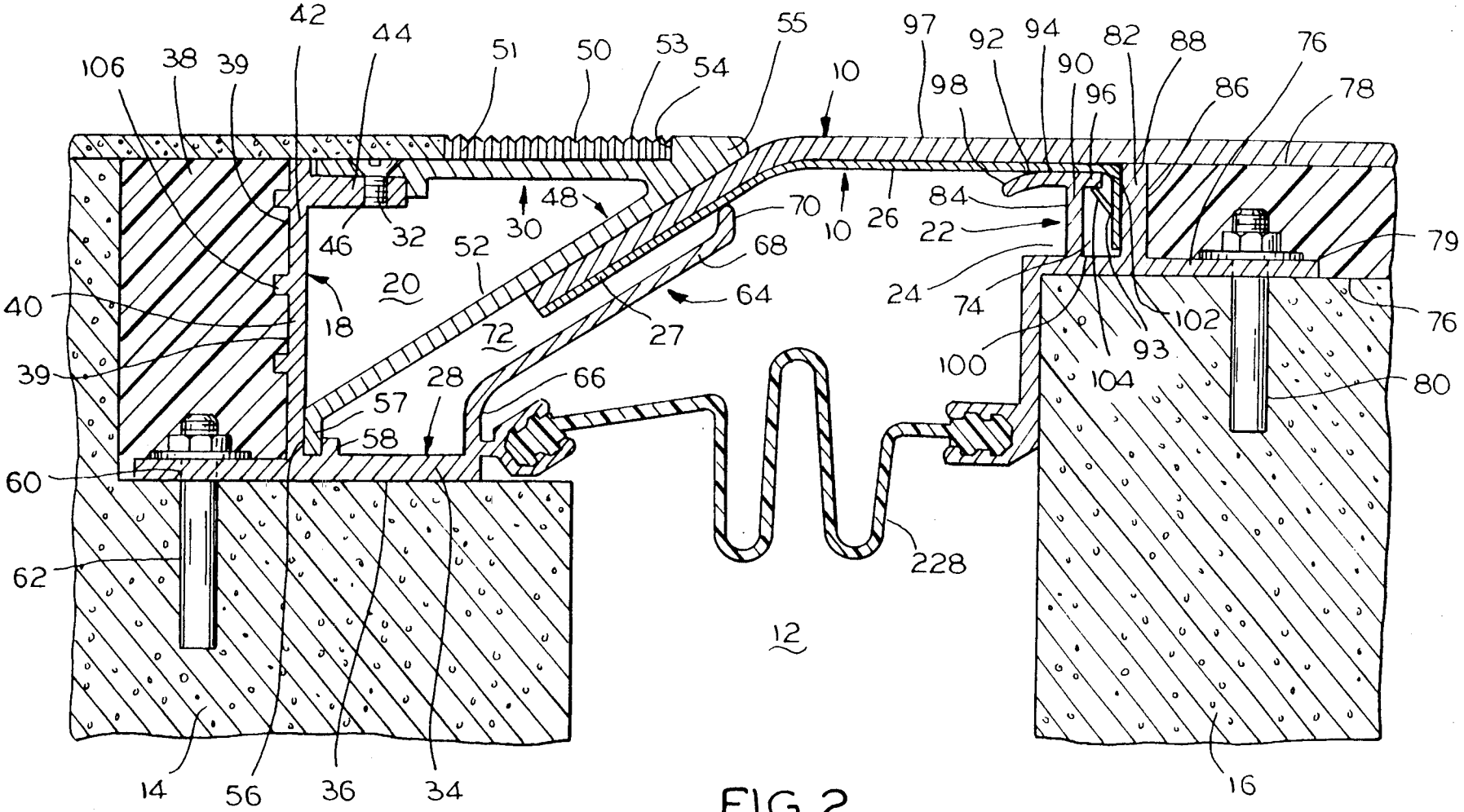
FIG. 2 is a transverse sectional view of the installed expansion joint cover assembly of FIG. 1 and the adjacent building sections with carpet laid thereon.

Referring now to FIGS. 1 and 2 of the drawing, there is illustrated an expansion joint cover assembly, generally designated by the numeral !0. In use: the expansion joint cover assembly !0 is installed overlying and covering an elongate expansion joint or space 12 between adjacent portions of a building structure having structural sections 14 and 16 spaced apart and separated by the expansion joint or space I2. The structural sections 14 and 16, as illustrated in FIGS. 1 and 2, are building floors. However, it is to be noted that the structural sections 14 and 16 may be two floor sections or a floor and a wall section, or other like structural components of a building within the scope of this invention. Such structural sections 14 and 16 may be constructed of any suitable material such as concrete, building blocks, bricks, metal, or any other suitable material or combination thereof.

The expansion joint cover assembly 10 is structured and dimensioned to cover the elongate expansion joint I2 which extends between structural sections 14 and 16. This assembly 10, furthermore, is adapted to accommodate relative movement between the adjacent sections 14 and 16. As illustrated in FIGS. 1 and 2, the assembly 10 includes an elongate rigid base member 18 positioned in a recessed area 20 formed in floor section 14 and secured to section 14 in a manner such that member !8 is held in a stationary or fixed position relative to section 14. Another elongate base member 22 is positioned in a recessed area 24 formed in floor section 16 and is secured to section 16 in a manner such that member 22 is held in a stationary or fixed position relative to section 16. Base members 28 and 30 may be fabricated from any suitable metallic material such as extruded metals including aluminum or brass or from a suitable plastic material.

The cover assembly 10 further, includes an elongate leaf spring cover member 26 constructed from any suitably springy or resilient material such as spring metal stock having a thickness sufficient to provide a joint cover construction capable of supporting a load of up to about 150 pounds per square foot. In use, it has been found that when the leaf spring cover member 26 is employed to cover a six-inch joint between structural sections, the leaf spring should have a thickness of up to about 0.062 inch for best results. In other applications, lesser thickness leaf springs have been found to be adequate for utilization such as, for example, a 0.030 inch thick leaf spring utilized for a four-inch joint. Furthermore, it has been found that if additional stiffness of the leaf spring is desired, an additional leaf may be affixed as by spot welding or the like to an end section of the leaf spring cover member 26 opposite the free end section 27.

In assembly, the leaf spring member 26 is fixedly and stationarily connected to base assembly 22 and bridges joint I2 overlying and covering the space between sections 14 and 16. The leaf spring member 26 is slidably engaged by and operatively interconnected with base 18 as will be further detailed hereinafter.

Base member 18 may be formed as a unitary construction, if desired. However, in a preferred embodiment of this invention, as illustrated, practical installation of the leaf spring 26 is facilitated by employing a member 18 comprising two elongate sub-sections 28 and 30 which are interconnected at one end via screws 32. Sub-section 28 includes a horizontally extending bottom portion or member 34 which is positioned in abutting engagement with a lower wall surface 36 formed in recess 20 of structural section 14. Wall surface 36 extends in a generally horizontal plane essentially parallel to an upwardly facing outer surface 38 of floor section 14. A laterally elongate vertical side portion or member 40 of sub-section 28 extends generally perpendicular to and upwardly from bottom portion 34 in abutting engagement with a side wall surface 39 in recess 20. The vertical side member 40 terminates in an end section 42 which lies in a plane substantially flush with the outer surface 38 of floor 14. Adjacent terminal section 42, an elongate lateral flange 44 is formed on vertical member 40. This flange 44 includes apertures or bores 46 which accommodate screws 32 for joining sub-assemblies 28 and 30.

Sub-section 30 comprises laterally elongate, rigid upper leg 50 and diagonal side leg 52. Leg 50 is structured and dimensioned to extend generally horizontally in a plane perpendicular or normal to vertical side portion 40 of sub-section 28 when sub-sections 28 and 30 are interconnected. Thus, an outer surface 51 of leg 50 lies in a plane essentially coextensive or flush with the essentially horizontal plane of outer surface 38 of floor 14. Accordingly, outer surface 51 of leg 50 is positioned to accommodate a floor covering 53 such as a carpet, tile, marble or the like or a decorative simulation thereof which is disposed or spread over the outer surface 38 of floor 14.

In order to further facilitate installation of the floor covering 53 on the outer surface 5I of leg 50, the leg 50 includes an abutment surface or lip 54 formed on the outer surface 5I adjacent a bending area or zone 55 on leg 50. The height of the lip 54 will vary depending on the thickness of the floor covering material 53. For example, the height of lip 54 will preferably be about $\frac{1}{4}$ inch for a carpet floor covering whereas the height of the lip 54 will preferably be about $\frac{1}{8}$ inch for tile floor covering. Thus, in installation, the floor covering 53 is laid directly over outer surface 38 of floor 14 and outer surface 5I of leg 50 in a continuous covering relationship with only a minimal tip portion of the underlying surface or structure of base member 18 (i.e., bending area 55) being exposed beyond the position at which the floor covering 53 abuttingly engages abutment surface 54.

Leg 52 extends diagonally downward from the bending area 55 on upper leg 50 at an acute angle relative to leg 50 so that when the sub-sections 28 and 30 are joined, the legs 50, 52 and vertical portion 40 essentially define a cantilever bracket member 48 with leg 52 defining the hypotenuse of a right triangle.

As noted previously, the sub-sections 28 and 30 are fixedly attached to each other at one end via screws 32. At the other end attachment of sections 28 and 30 is completed by engaging free end 57 of side leg 52 within a detent 56 formed between the vertical side member 40 of sub-assembly 28 and an adjacent upwardly projecting elongate rib or peg 58 on bottom portion 34 of sub-assembly 28. The rib or peg 58 extends generally perpendicularly from the bottom portion 34 and essentially parallel to the vertical side potion 40.

Apertures or bores 60 are formed in bottom member 34 adjacent one end thereof to accommodate a bolt arrangement 62 such as a Hilti "Kwik" bolt for connecting the base 18 to floor section 14. An armature assembly 64 extends upwardly from the other or free end of bottom member 34 with a first section 66 extending generally normal or perpendicular to member 34 and a second section 68 being bent at a acute angle from the first section extending upwardly in a plane essentially parallel to the plane of leg 52. Section 68 terminates in curved free elongate top portion 70 which extends generally perpendicularly from the bottom portion 34.

Thus, in assembly, second section 68 of armature assembly 64 extends generally parallel to side leg 52 of the cantilever bracket member 48 and a passageway or channel 72 is formed therebetween. This passageway 72 bordered by leg 52 and second section 68 with top portion 70 of section 68 projecting upwardly into passageway 72 is structured and dimensioned to receive the free end section 27 of leaf spring cover member 26 in a manner such that the free end section 27 of the leaf spring 26 is supportively and slidably engaged within the passageway 72 to accommodate multi-directional relative movement between the adjacent structures 14 and 16. Additionally, portion 70 on section 68 of armature 64 is positioned to press against the end section 27 of leaf spring cover member 26 exerting an upwardly directed compressive force for retaining the cover member 26 in position within the passageway 72 and for resisting disengagement of the member 26 from proper positioning.

Rigid base assembly 22 includes a laterally elongate, horizontally extending bottom portion or member 74 which is positioned in abutting engagement with a lower wall surface 76 formed in recess 22 of structural section 16. Wall surface 76 extends in a generally horizontal plane essentially parallel to an upwardly facing outer surface 78 of floor section 16 which, as illustrated, is essentially coplanar with the upwardly facing outer surface 38 of floor section 14. Bottom member 74 has an aperture or bore 79 formed therein adjacent one of its ends to accommodate a bolt arrangement 80 such as a Hilti "Kwik" bolt for connecting the base 22 to floor section 16.

Base assembly 22 further includes two generally vertical, longitudinally spaced, laterally elongate wall members 82 and 84 which project from the bottom member 74 at essentially right angles thereto. Wall member 82 extends upwardly in abutting engagement with a side wall surface 86 formed in recess 22 and terminates in an end section 88 which lies in a plane substantially flush with the outer surface 78 of floor 16. Wall member 84 extends upwardly to a terminal section 90 which comprises a laterally elongate rigid cross member 92 having a substantially flat top surface 94 positioned centrally thereof interconnecting side surfaces 96 and 98. Side surface 96 comprises a continuation of the flat top surface 94 and extends in the longitudinal direction toward wall member 82 defining a flange or abutment surface 93 which extends into a channel 100 formed between the vertical wall members 82 and 84. Side surface 98 comprises a inclined surface rising from its opposite end to join at its uppermost portion with the substantially flat central top surface 94.

Cross member 92 provides support for leaf spring cover member 26 as it projects longitudinally in a direction across joint 12 toward base member 18 in a plane essentially coextensive or flush with the outer surface 78 of floor 16 and outer surface 38 of floor 14. Accordingly, leaf spring cover member 26 is positioned to accommodate a floor covering 97 such as a carpet, tile, marble or the like or a decorative simulation thereof which is disposed or spread over the outer surface 78 of floor 16. As illustrated the floor covering 97 supported on cover member 26 extends completely across joint 12 and extends into passageway 72 so that the surface or structure of the leaf spring cover member 26 and base member 22 ar completely covered by the floor covering 97 and are not exposed to view when the assembly 10 is installed.

In the reverse direction adjacent an end section 102 oppositely disposed from free end section 27 of leaf spring 26, the leaf spring 26 is bent downwardly at a generally right angle to the plane of the outer surface 78 of floor 16 to enter channel 100 between the vertical walls 82 and 84 of base member 22. End section 102 of leaf spring cover member 26 includes an upwardly projecting engagement arm or barb member 104 which is structured and dimensioned and likewise is positioned within the channel 100 to engage flange 93 so as to fixedly interconnect leaf spring cover member 26 with base member 22.

Installation of the expansion joint cover assembly 10 illustrated in FIGS. 1 and 2 between adjacent floor sections 14 and 16 is accomplished by mounting base member 22 in recess 24 and securing the base member 22 to a concrete portion of section 16 via bolt arrangement 80. Thereafter, recess 24 is filled with grout and base member 22 is bonded thereto. Likewise, sub-section 28 of base member 18 is mounted in recess 20 by securing it to a concrete portion of structural section 14 via bolt arrangement 62 and then filling recess 20 with grout and bonding sub-section 28 including side wall 39 with ribs 106 formed thereon to the grouted portion of section 14. Then end section !02 of leaf spring 26 is fixedly and stationarily interconnected with base member 22 via engagement of engagement arm 104 on leaf spring 26 with flange 93 on base member 22. The leaf spring cover member 26 is then extended across the joint 12 and the free end section 27 of leaf spring cove member 26 with floor covering 97 positioned thereon and affixed thereto. Thereafter, sub-section 30 of base member 18 is interconnected with the previously secured sub-section 28 by engaging the free end 57 of the diagonal side leg 52 of sub-section 30 within detent 56 in sub-section 28 and by engagement of screw 32 with sub-sections 28 and 30. In this manner, free end section 27 of leaf spring 26 having floor covering 97 secured thereto is captured and secured within passageway 72 formed between diagonal side leg 52 of sub-section 28 and second section 68 of armature assembly 64 with top portion 70 of section 68 pressing against end section 27.

Figure 3:
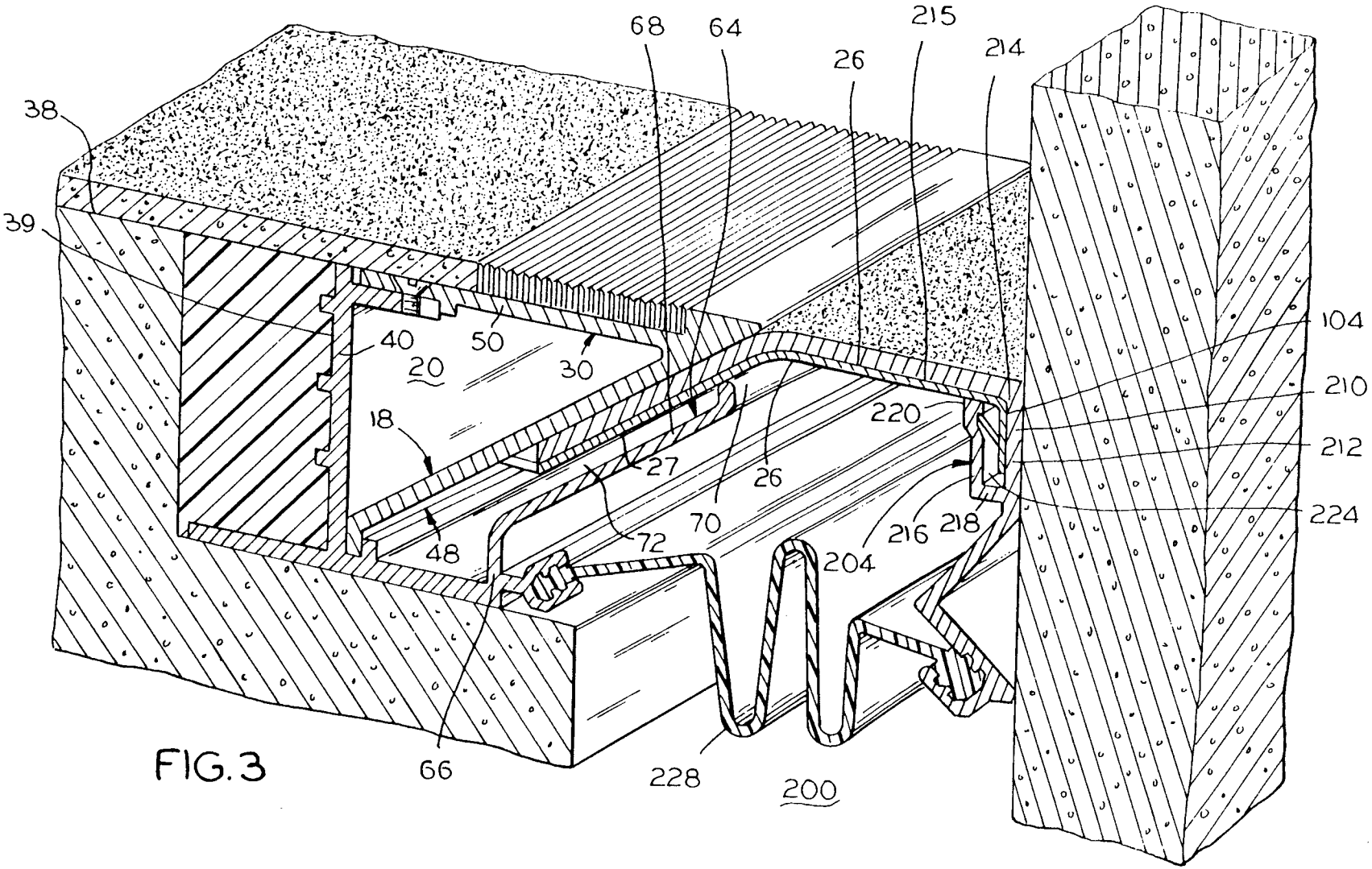
FIG. 3 is a partial perspective view of another embodiment of the expansion joint cover assemblies of the present invention installed to cover an expansion joint adjacent angularly disposed wall an carpeted floor sections.
Figure 4:
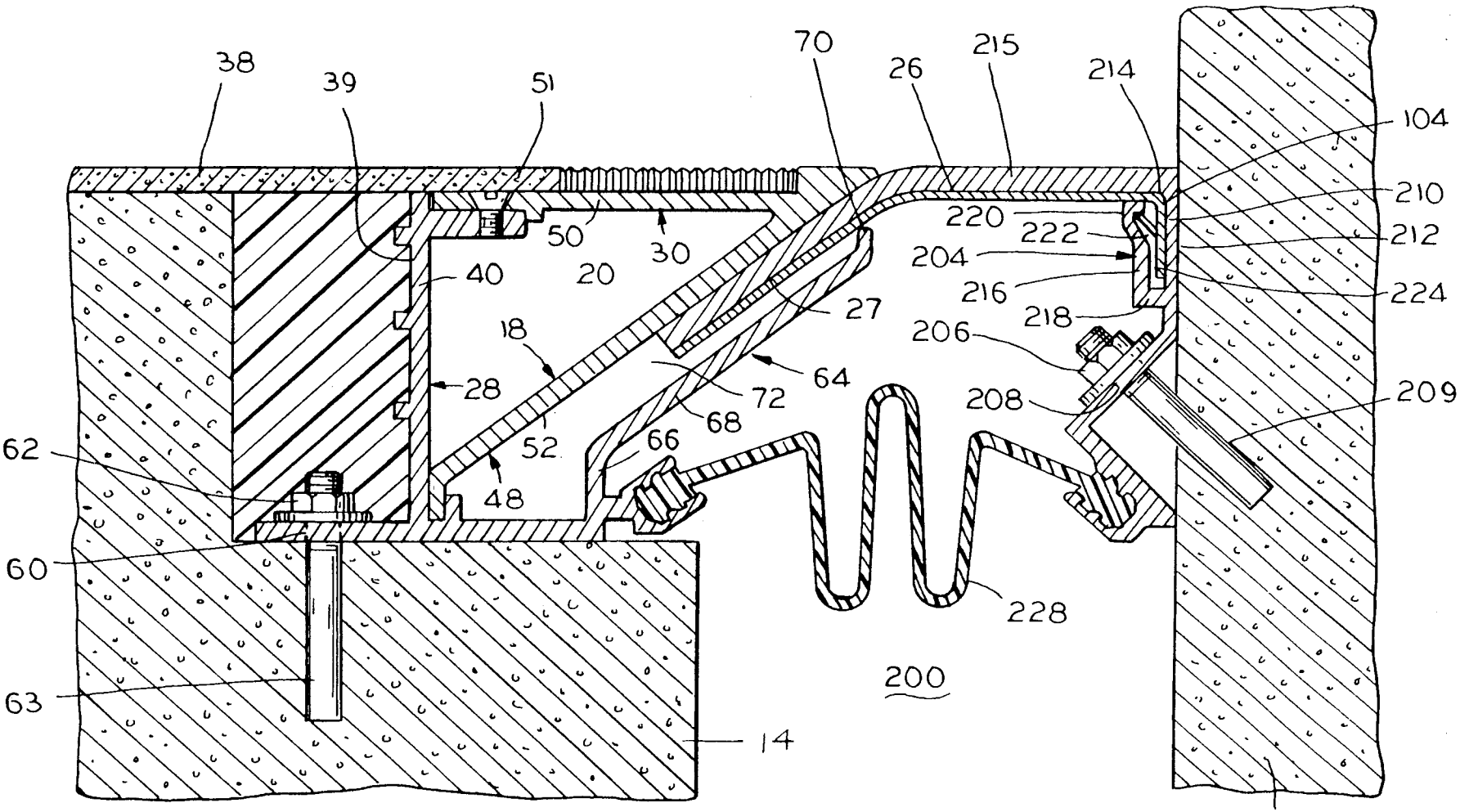
FIG. 4 is a transverse sectional view of the installed expansion joint cover assembly of FIG. 3 and the adjacent building sections with carpet laid thereon.

FIGS. 3 and 4 illustrate an embodiment of the expansion joint cover assembly 10 for use in bridging an elongate expansion joint 200 formed between structural floor section 14 and a structural wall section 202. As previously described, base member 18 is mounted and secured in a recess 20 of the structural section 14. Sub-sections 28 and 30 are interconnected to form base member 18 in order to provide a cantilever bracket member 48 with leg 50 lying in a plane essentially coextensive or flush with the plane of the outer surface 38 of floor 14 and vertical side member 40 in abutting engagement with side wall 39 of recess 20 and with side leg 52 extending diagonally downward from leg 50 at an acute angle relative to leg 50 for joinder with leg 52. Likewise, armature assembly 64 extends generally parallel to side leg 52 to form a passageway or channel 72 therebetween.

In the assembly 10 illustrated in FIGS. 3 and 4, a base member 204 is secured to structural section 202 by a bolt arrangement 206 such as a Hilti "Kwik" bolt received through an aperture 208 formed in base member 204 The base member 204 includes a generally vertical, laterally elongate wall member 210 which extends upwardly in abutting engagement with a side wall surface 212 of structural section 202 to an upper end 214 which terminates in a plane essentially coplanar with the plane 38 of floor section 14.

Base member 204 also includes a second generally vertical, laterally elongate wall member 216 which is spaced from wall member 210 and projects upwardly essentially perpendicular to a bottom section 218 which extends from wall member 210 essentially normal thereto. Wall member 216 terminates at an upper end 220 in a plane essentially coplanar with the plane 38 of floor section 14 and the upper end of wall member 216. A detent or groove 222 is formed in wall member 216 adjacent upper end 220 and a channel 224 is formed between the vertical wall members 210 and 216.

The assembly 10 includes a leaf spring cover member 26 which is the same in construction as previously described wherein a free end section 27 is supportively and slidingly engaged within passageway 72 and the oppositely disposed end section 102 of the leaf spring 27 is bent downwardly at a generally right angle to enter channel 224 between the vertical walls 210 and 216. The leaf spring cover member 26, as illustrated in FIGS. 3 and 4, has a floor covering 2!5 affixed thereto. The member 26 also includes an upwardly projecting engagement arm or barb member 104 which is structured and dimensioned as well as being positioned within the channel 224 to engage the detent or groove 222 in wall member 216 in order to fixedly interconnect the leaf spring cover member 26 thereto.

Installation of the assembly 10 as illustrated in FIGS. 3 and 4 is accomplished by the same procedure detailed in regard to the assembly 10 of FIGS. I and 2. That is, base member 18 and base member 204 are respectively secured to structural sections 14 and 202 and leaf spring cover member 26 is fixedly interconnected with base member 204 via engagement of engagement arm 104 on leaf spring 26 with detent or groove 222 in wall member 216. The leaf spring cover member 26 is then extended across joint 200 and sub-section 30 of base member 18 is secured to base member 28 thereby capturing or securing free end section 27 of leaf spring 26 having floor covering 215 affixed thereto within the passageway 72 formed between diagonal side leg 52 of sub-section 30 and second section 68 of armature 64 of sub-section 28 with top portion 70 of section 68 pressing against end section 27.

Figure 5:
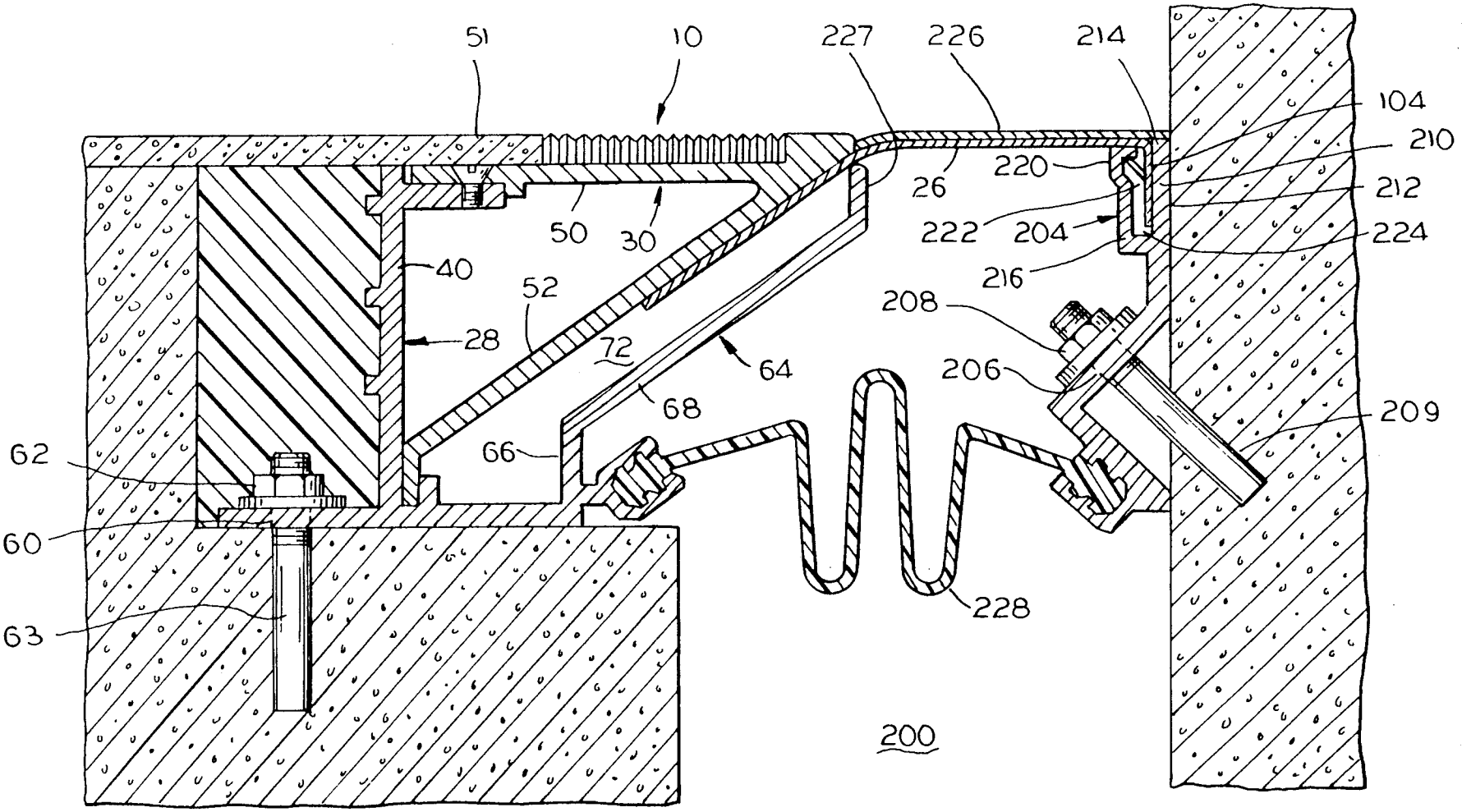
FIG. 5 is a transverse sectional view of an alternate embodiment of the expansion joint cover assemblies of the present invention in a form for covering an expansion joint between a floor section having a thin, flexible decorative covering such as a foil or vinyl sheet applied to the cover and an adjacent wall section.

FIG. 5 illustrates a further embodiment of this invention which is essentially the same as that illustrated in FIGS. 3 and 4 except that the construction is adapted to accommodate a thin decorative floor covering 226 such as a foil rather than the heretofore illustrated carpet floor covering. As will be noted, the armature assembly 64 includes a top portion 227 which is vertically elongated or extended relative to the previously described top portion 70 illustrated in FIGS. 1–4. The extension of the length of top portion 227 results in the application of upwardly directed pressure enabling the assembly 10 to be utilized for thin foil coverings as well as for thicker floor coverings such as carpet. Furthermore, if desired, a spacer device may be affixed to the free end section 27 of leaf spring cover member 26 in order to provide better engagement between top portion 227 of armature 64 and cover member 26.

A standard gutter member 228 of extruded elastomeric material is secured between the base members 18 and 22 as illustrated in FIGS. 1 and 2 and 18 and 204 as illustrated in FIGS. 3-5 in order to collect and convey moisture passing between the adjacent, spaced structural sections.

While there have been described what are at present considered to be the preferred embodiments of the invention, it will be understood that various modifications may be made therein, and it is intended to cover in the appended claims all such modifications as fall within the true spirit and scope of the invention.

We claim:

1. An expansion joint cover assembly for a joint formed between first and second adjacent, spaced structural sections, said second structural section having a recess formed therein, said assembly comprising in combination:

a first elongate base member stationarily secured to said first structural section and a second elongate base member positioned within the recess formed in said second structural section and stationarily secured to said second structural section;

an elongate cover member having oppositely disposed, longitudinally spaced first and second end sections, said first end section being fixedly and stationarily interconnected with said first base member;

said second base member including a passageway therein for receiving the second end section of said cover member in supporting, sliding engagement; and said cover member extending across said joint in a cantilever manner overlying and covering said joint with said second end section of said cover member inserted in said passageway to accommodate relative movement of the adjacent, spaced structural sections and to assure proper alignment of the cover member.

2. The assembly of claim 1 wherein said cover member comprises a leaf spring.

3. The assembly of claims 2 wherein said leaf spring is of a thickness sufficient to support a load of up to about 150 pounds per square foot.

4. The assembly of claim 3 wherein said leaf spring has a thickness up to about 0.062 inches.

5. The assembly of claim 1 wherein said first end section of said cover member is fixedly interconnected with said first base member via engagement means on said first end section engaging a flange or detent formed on said first base member.

6. The assembly of claim 5 wherein said engagement means on said first end section of said cover means comprises a barb extending from said first end section.

7. The assembly of claim 1 wherein said recess in said second structural section includes a substantially vertical side wall interconnecting a generally horizontal lower wall and an upwardly facing outer surface in essentially parallel and spaced relationship and said second base member comprises a cantilever bracket member having a laterally elongate substantially vertical side member in abutting engagement with said vertical side wall, a substantially horizontal laterally elongate upper leg lying in plane essentially coextensive with said upwardly facing outer surface, a laterally elongate side leg extending downwardly from said upper leg to said vertical leg at an acute angle relative to said upper leg and a laterally elongate bottom member extending substantially horizontally from said vertical side member, said bottom member terminating in a free end section with an armature assembly extending upwardly therefrom, said armature assembling including at least a section which extends generally parallel to said side leg of said bracket forming said passageway and said armature assembly terminating in a top portion which projects upwardly into said passageway to engage said cover member.

8. The assembly of claim 1 wherein said first elongate base member is positioned within a recess formed in said first structural section.

9. An expansion joint cover assembly for a joint formed between first and second adjacent, spaced structural sections, said second structural section having a recess formed therein, said recess in said second structural section including a substantially vertical side wall interconnecting a generally horizontal lower wall and an upwardly facing outer surface in essentially parallel and spaced relationship, said assembly comprising in combination:

a first elongate base member stationarily secured to said first structural section;

a second elongate base member positioned within the recess formed in said second structural section and stationarily secured to said second structural section and an elongate leaf spring cover member having oppositely disposed, longitudinally spaced first and second end sections, said first end section being fixedly and stationarily interconnected with said first base member;

said second base member comprising a cantilever bracket member having a laterally elongate substantially vertical side member in abutting engagement with said vertical side wall, a substantially horizontal laterally elongate upper leg lying in a plane essentially coextensive with said upwardly facing outer surface, a laterally elongate side leg extending downwardly from said upper leg to said vertical leg at an acute angle relative to said upper leg and a laterally elongate bottom member extending substantially horizontally from said vertical side member, said bottom member terminating in a free end section with an armature assembly extending upwardly therefrom, said armature assembling including at least a section which extends generally parallel to said side leg of said bracket forming a passageway therein for receiving the second end section of said leaf spring cover member in supporting, sliding engagement;

said leaf spring cover member extending across said joint overlying and covering said joint with said second end section of said leaf spring cover member inserted in said passageway to accommodate relative movement of the adjacent, spaced structural sections and to properly align the cover member; and said armature assembly having a top portion which projects upwardly into said passageway to engage said leaf spring cover member whereby said leaf spring cover member is maintained in alignment.

10. The assembly of claim 9 wherein said leaf spring cover member is of a thickness to support a load of up to about 150 pounds per square foot.

11. The assembly of claim 10 wherein the leaf spring cover member has a thickness up to about 0.062 inches.

12. An expansion joint cover assembly for a joint formed between first and second adjacent, spaced structural sections comprising in combination first and second elongate base members secured to the adjacent structural sections;

a leaf spring cover member fixedly and stationarily interconnected to said first base member at one end and bridging the joint between the structural sections in a cantilever manner such that the cover member lies in a plane essentially coextensive with at least one of said structural sections; and said leaf spring cover member being structured and dimensioned to be slidably interconnected with said second base member.

13. The assembly of claim 12 wherein said second base member includes a passageway therein for receiving a second end of said leaf spring cover member oppositely disposed from said first end in supporting sliding engagement and said second end of said leaf spring cover member is inserted in said passageway whereby relative movement of said first and second structural sections is accommodated and proper alignment of said cover member is assured.

14. The assembly of claim 13 wherein said first end section of said leaf spring cover member is fixedly interconnected with said first base member via engagement means on said first end section engaging a flange formed on said first base member.

15. The assembly of claim 14 wherein said engagement means on said first end section of said cover means comprises a barb extending from said first end section.

16. The assembly of claim 12 wherein said first elongate base member is positioned within a recess formed in said first structural section and said second elongate base member is positioned within a recess formed in said second base member.

17. The assembly of claim 12 wherein said second elongate base member is positioned within a recess formed in said second structural section and said second structural section includes substantially vertical side wall interconnecting a generally horizontal lower wall and an upwardly facing outer surface in essentially parallel and spaced relationship and said second base member comprises a cantilever bracket member having a laterally elongate substantially vertical side member in abutting engagement with said vertical side wall, a substantially horizontal laterally elongate upper leg lying in a plane essentially coextensive with said upwardly facing outer surface, a laterally elongate side leg extending downwardly from said upper leg to said vertical leg at an acute angle relative to said upper leg and a laterally elongate bottom member extending substantially horizontally from said vertical side member, said bottom member terminating in a free end section with an armature assembly extending upwardly therefrom, said armature assembling including at least a section which extends generally parallel to said side leg of said bracket forming said passageway and said armature assembly terminating in a top portion which projects upwardly into said passageway to engage said cover member.

18. The assembly of claim 17 wherein said first elongate base member is positioned within a recess formed in said first structural section.

19. The assembly of claim 17 wherein said leaf spring is of a thickness sufficient to support a load of up to about 150 pounds per square foot.

20. The assembly of claim 17 wherein said leaf spring has a thickness up to about 0.062 inches.

* * * * *

UNITED STATES PATENT AND TRADEMARK OFFICE

CERTIFICATE OF CORRECTION

PATENT NO. : 5,060,439

DATED : October 29, 1991

INVENTOR(S) : Matthew J. Clements, et al.

It is certified that error appears in the above-indentified patent and that said Letters Patent is hereby corrected as shown below:

Column 2, line 57, "o" should be --of--
Column 3, line 4, "a" should be --an--
Column 3, line 41, "an" should be--and--
Column 3, lines 60 & 61, "!0" should be --10--
Column 3, line 65, "I2" should be --12--
Column 4, line 9, "I2" should be --12--
Column 4, line 15, "!8" should be --18--
Column 4, line 45, "I2" should be --12--
Column 5, lines 18, 20 & 28, "5I" should be --51--
Column 5, line 42, "end" should be --end,--
Column 5, line 57, "a" should be --an--
Column 5, lines 59 & 60, "in curved" should be --in a curved--
Column 6, line 43, "a" should be --an--
Column 6, line 59, "ar" should be --are--
Column 7, line 18, "!02" should be --102--
Column 7, line 23, "cove" should be --cover--
Column 7, line 57, first occurrence, "204" should be --204.--
Column 8, line 10, "leaf spring 27" should be --leaf spring 26--
Column 8, line 14, "2!5" should be --215--
Column 8, line 23, "FIGS. I" should be --FIGS. 1--
Column 9, line 29, "claims" should be --claim--
Column 10, line 57, "combination" should be --combination:--

UNITED STATES PATENT AND TRADEMARK OFFICE

CERTIFICATE OF CORRECTION

PATENT NO. : 5,060,439
DATED : October 29,1991
INVENTOR(S) : Matthew J. Clements, et al.

It is certified that error appears in the above-indentified patent and that said Letters Patent is hereby corrected as shown below:

Column 11, line 26, "includes substantially" should be --includes a substantially--.

Signed and Sealed this

Twenty-eighth Day of September, 1993

Bruce Lehman

*Attest:*

BRUCE LEHMAN

*Attesting Officer*

*Commissioner of Patents and Trademarks*